US005242117A

United States Patent [19]

D'Agostino et al.

[11] Patent Number: 5,242,117

[45] Date of Patent: Sep. 7, 1993

[54] FUEL INJECTOR FOR A GAS TURBINE ENGINE

[75] Inventors: Guy D'Agostino, Vitry sur Seine; Gérard Y. G. Barbier, Morangis; Xavier M. H. Bardey, Chartrettes, all of France

[73] Assignee: Societe Nationale d'Etude et de Construction de Moteurs d'Aviation, Paris, France

[21] Appl. No.: 996,129

[22] Filed: Dec. 23, 1992

[30] Foreign Application Priority Data

Dec. 24, 1991 [FR] France ..... 91 16095

[51] Int. Cl.[5] ..... F02C 7/22; F23R 3/28; F23R 3/30

[52] U.S. Cl. ..... 239/533.2; 239/569; 60/741; 60/742; 137/110

[58] Field of Search ..... 239/533.1, 533.2, 533.15, 239/569, 570, 446–448; 60/741, 742; 137/110, 513, 516.27

[56] References Cited

U.S. PATENT DOCUMENTS 3,002,353 10/1961 McEneny ..... 239/533.2
3,081,952 3/1963 Woodward et al. ..... 239/533.2
3,095,153 6/1963 Soth ..... 60/741
4,139,157 2/1979 Simmons ..... 239/400
4,928,491 5/1990 Lindsay et al. ..... 60/734
4,970,865 11/1990 Shekelton et al. ..... 60/742

FOREIGN PATENT DOCUMENTS 332451 1/1921 Fed. Rep. of Germany .
2665729 2/1992 France .

*Primary Examiner*—Andres Kashnikow
*Assistant Examiner*—Karen B. Merritt
*Attorney, Agent, or Firm*—Bacon & Thomas

[57] ABSTRACT

A fuel injector is disclosed for injecting fuel into a combustion chamber of a gas turbine engine which includes an injector nozzle having a central axis, first and second fuel injection paths in which one of the fuel injection paths supplies fuel to the injector nozzle while the other fuel injection path has an outlet displaced from the axis of the injection nozzle, a single fuel supply conduit which supplies fuel to both of the fuel injection paths, and a metering device which controls the flow of fuel from the single fuel supply conduit to the first and second fuel injection paths. The metering device may be a fuel metering valve assembly which has a piston defining a fuel metering orifice biased against a valve seat around an opening which communicates with the single fuel supply conduit. The piston is biased into engagement with the valve seat by a resilient bellows attached between the piston and a fixed structure.

9 Claims, 2 Drawing Sheets

FUEL INJECTOR FOR A GAS TURBINE ENGINE

BACKGROUND OF THE INVENTION

The present invention relates to a fuel injector for a gas turbine engine, more particularly such a fuel injector having two fuel injection paths supplied by a common fuel supply conduit.

The performance of a combustion chamber for a gas turbine engine is directly related to the features of its fuel injector, namely the size of the fuel particles, as well as the spatial and radial fuel distribution. These features vary widely, depending upon the operating mode of the gas turbine engine, thereby making it increasingly difficult to achieve desired engine performance for all engine operating modes.

The proportion of air and fuel injected into the combustion chamber usually involves tradeoffs between engine performance under full power conditions, and engine performance at low power conditions. Reignition of the engine at altitude and the increasing demands for controlling harmful emissions from the engine have increased the considerations in fuel chamber/fuel injector design. Accordingly, the use of single, fixed geometry fuel injectors has resulted in an increasingly more difficult tradeoff between the various operational parameters of the gas turbine engine.

At present, engines are fitted with aerodynamic injectors improved by variable geometry devices to continuously match the air proportion to the engine's operational mode by means of movable elements acting as diaphragms for the combustion chamber air intakes. However, the aerodynamic injector has a low efficiency for low power operations., Fuel injector systems have been designed to incorporate mechanical as well as aerodynamic injectors in which the mechanical injector operates under low power operating conditions, while the aerodynamic injector operates at medium and full power conditions. A typical example of such a design can be found in French patent 2,665,729. However, these types of injectors, which use separate fuel supply conduits for each of the injector types, requires a significant amount of time to fill the fuel feed paths and to switch between the different types of fuel injectors.

SUMMARY OF THE INVENTION

A fuel injector is disclosed for injecting fuel into a combustion chamber of a gas turbine engine which includes an injector nozzle having a central axis, first and second fuel injection paths in which one of the fuel injection paths supplies fuel to the injector nozzle while the other fuel injection path has an outlet displaced from the axis of the injection nozzle, a single fuel supply conduit which supplies fuel to both of the fuel injection paths, and a metering device which controls the flow of fuel from the single fuel supply conduit to the first and second fuel injection paths.

The metering device may be a fuel metering valve assembly which has a piston defining a fuel metering orifice biased against a valve seat around an opening which communicates with the single fuel supply conduit. The piston is biased into engagement with the valve seat by a resilient bellows attached between the piston and a fixed structure.

Under initial startup and low power operating conditions, fuel passes from the supply conduit, through the fuel metering orifice, through an interior chamber defined by the bellows, through passages defined by the fixed structure and exits through the injector nozzle.

Under medium and high power operating conditions, the pressure differential across the piston is sufficient to displace it away from the valve seat against the biasing force of the bellows, thereby opening up the aerodynamic fuel injector path, which includes a chamber surrounding the bellows and which also communicates with the fuel supply conduit once the piston has been displaced from its valve seat. In an extreme displaced position, the piston blocks the passages, thereby closing off the mechanical fuel injection path and forcing all of the fuel to be supplied to the combustion chamber through the aerodynamic fuel injection path.

The fuel injector according to the present invention eliminates the drawbacks of the known fuel injector systems by supplying fuel to the combustion chamber under optimum conditions for all engine operating modes. The present fuel injector system allows each of the two fuel injection paths to be utilized alone, or for the paths to be utilized simultaneously to provide the optimal fuel supply to the combustion chamber. The fuel supply system is simplified by its use of a single fuel supply conduit.

DETAILED DESCRIPTION OF THE PREFERRED EMBODIMENT

Figure 1:
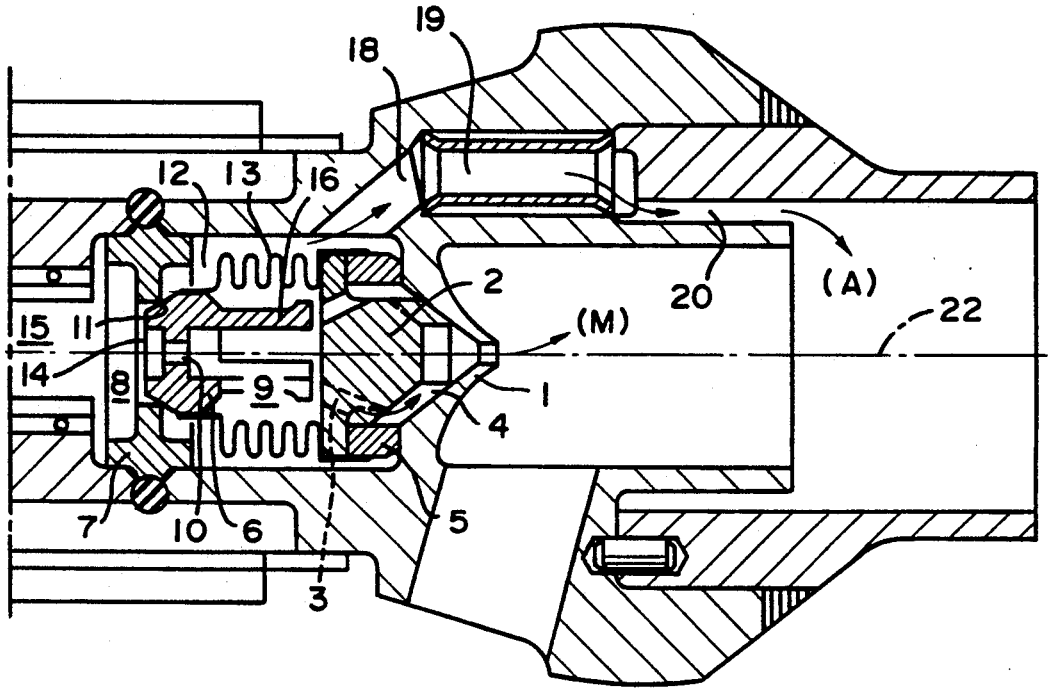
FIG. 1 is a longitudinal cross-sectional view of the fuel injector according to the present invention.
Figure 2:
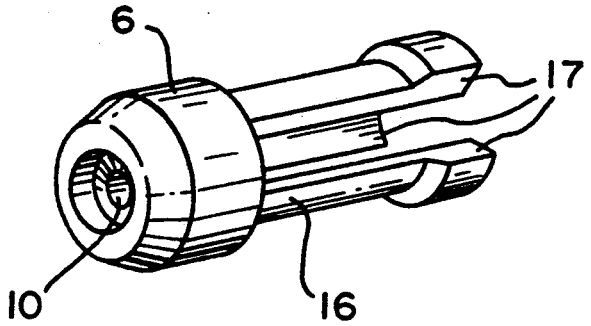
FIG. 2 is a perspective view of the piston utilized in the fuel injector shown in FIG. 1.

The fuel injector according to the present invention, as illustrated in FIG. 1, defines first and second fuel injection paths, a mechanical path M for initial start up and low-power operating conditions, and an aerodynamic path A for intermediate and full power engine operation. A metering valve assembly, comprising elements 2, 5, 6 and 13 controls the flow of fuel from a single fuel supply conduit 15 to either, or both, of the fuel injection paths. The aerodynamic fuel injection path A comprises chamber 12, passageway 18, passageway 19 and annular passageway 20 through which fuel may pass when chamber 12 communicates with the single fuel supply conduit 15. The low power, mechanical fuel injection path M comprises fuel metering orifice 10, interior chamber 9, passageways 3 and groove 4 which communicates with the injector nozzle defined by nozzle structure 1. The use of fuel injection path A, M, or a combination thereof, ensures optimal fuel supply to the engine combustion chamber over the entire range of engine operating modes.

The fuel injector 1 defines a fuel injector nozzle having a longitudinal axis 22, with which single fuel supply conduit 15 is generally coaxial.

The mechanical fuel injection path M includes a fuel injector nozzle structure 1, which may be integrally formed with an injector end piece, and end piece 2 which defines passages 3 and grooves 4 which communicate with the fuel injector nozzle. A spacer 5 having an inside diameter large enough to allow fuel to pass from the passages 3 into the grooves 4, spaces the end piece 2 from the fuel injector nozzle structure 1. Piston 6 is attached to the end piece 2 via a resilient, elastic bellows 13 such that, under low power operating conditions, the bellows biases the piston 6 against valve seat 7 which defines an opening communicating with the single fuel supply conduit 15. The piston 6, the bellows 13 and the end piece 2 define an inner chamber 9 which is in fluid communication with the single fuel supply conduit 15 through fuel metering orifice 10, defined in the head portion of the piston 6.

The fuel flow through the fuel metering orifice 10 is defined by:

$$Q = KS\sqrt{\Delta p}$$

where:

Q=the fuel flow;

K=a coefficient characteristic of the orifice being used;

S=the cross section of the orifice

Δp=the pressure differential between upstream and downstream sides of the orifice.

Under initial start up and low power operating conditions, the pressure differential between the upstream and downstream sides of the fuel metering orifice 10 is insufficient to displace the piston 6 from its engagement with line 11 of valve seat 7. Thus, under these conditions, the fuel follows a path from upstream cavity 8, through the fuel metering orifice 10, into the inner chamber 9, through passageways 3, into groove 4 and through the injector nozzle 1. During this operational stage, the contact between the piston 6 and the valve seat 7 prevents fuel from entering the outer chamber 12 and flowing along the aerodynamic fuel injection path.

The bellows 13, which may be soldered, brazed or otherwise bonded to piston 6 and end piece 2, along with the piston 6, the spacer 5 and the end piece 2 constitute the metering valve assembly. The spacer 5 and the end piece 2 may, of course, be formed from a single piece. Although the invention is described in conjuction with this specific metering valve assembly, quite obviously other metering valves may be utilized which perform analogous functions.

As the engine power output increases, the fuel flow in single fuel supply conduit 15 also increases, thereby increasing the pressure differential across the fuel metering orifice 10. Once this differential pressure reaches a predetermined threshold value, the force acting on the upstream side 14 of the piston 6 overcomes the biasing force of the bellows 13 and displaces valve 6 from the valve seat 7. Once piston 6 is displaced to its extreme position, it will contact the end piece 2 to block passages 3, thereby preventing fuel from passing through the mechanical fuel injection path M.

Once piston 6 is displaced from the valve seat 7, fuel may flow through the aerodynamic fuel injection path A to thereby supply the requisite fuel to the combustion chamber. The piston 6 may define a piston skirt 16 which may comprise a plurality of legs 17 extending generally axially from the piston 6. The number of legs 17 may equal the number of passages 3 defined by the end piece 2, such that, as the piston 6 is displaced toward its maximum displaced position, the ends of the legs 17 block the passages 3. Obviously, the structure of piston 6 may vary and the plurality of legs 17 may be replaced by a continuous, annular skirt.

The threshold at which the mechanical fuel injection path M is shut off is determined by the magnitude of the pressure drop across the fuel metering orifice 10 and, hence, by the magnitude of the total fuel flow given by the above formula. The fuel metering valve assembly enables the fuel to be supplied to the aerodynamic fuel injection path A, the mechanical fuel injection path M, as well as both paths simultaneously.

The foregoing description is provided for illustrative purposes only and should not be construed as in any way limiting this invention, the scope of which is defined solely by the appended claims.

We claim:

1. A fuel injector for injecting fuel into a combustion chamber of a gas turbine engine comprising:

a) an injector nozzle having a central axis;

b) a first fuel injection path having a fuel outlet laterally displaced from the central axis of the injector nozzle;

c) a second fuel injection path located so as to supply fuel to the injector nozzle;

d) a single fuel supply conduit operatively associated with both first and second fuel injection paths; and, e) metering means operatively associated with the fuel supply conduit, the first fuel injection path and the second fuel injection path to control the flow of fuel from the conduit to the first and second fuel injection paths as a function of fuel flow through the fuel supply conduit.

2. The fuel injector of claim 1 wherein the metering means comprises a fuel metering valve.

3. The fuel injector of claim 2 wherein the fuel metering valve comprises:

a) a fuel opening communicating with the single fuel supply conduit and a valve seat adjacent to the fuel opening;

b) a piston defining a fuel metering orifice;

c) an end piece; and, d) a resilient bellows connecting the end piece and the piston such that, when the fuel flow through the single fuel supply conduit is below a threshold level, the bellows biases the piston against the valve seat and, when the fuel flow is above the threshold level, the piston is displaced from the valve seat.

4. The fuel injector of claim 3 wherein the first fuel path includes a first feed chamber communicating with the single fuel supply conduit when the piston is displaced from the valve seat.

5. The fuel injector of claim 3 wherein the bellows the piston and the end piece define a second feed chamber communicating with the fuel metering orifice and the second fuel injection path.

6. The fuel injector of claim 5 wherein the second fuel injection path comprises a plurality of passages defined by the end piece, each passage communicating with the second feed chamber, and a groove defined by the end piece and communicating with the plurality of passages and the injector nozzle.

7. The fuel injector of claim 6 wherein the piston comprises:

a) a piston head portion defining the fuel metering orifice; and, b) a plurality of legs axially extending from the piston head portion.

8. The fuel injector of claim 7 wherein the number of legs is equal to the number of passages defined by the end piece such that, when the piston is displaced from the valve seat, the legs block the passages, thereby preventing fuel from passing through the second fuel injection path.

9. The fuel injector of claim 3 wherein the piston comprises means to block the second fuel injection path when displaced from the valve seat so as to prevent fuel from flowing through the second fuel injection path.

* * * * *